US007857909B2

(12) United States Patent
Käske

(10) Patent No.: US 7,857,909 B2
(45) Date of Patent: Dec. 28, 2010

(54) CLEANING DEVICE INCLUDING A FLOOD CHAMBER

(75) Inventor: Egon Käske, Aachen (DE)

(73) Assignee: Dürr Ecoclean GmbH (DE)

( * ) Notice: Subject to any disclaimer, the term of this patent is extended or adjusted under 35 U.S.C. 154(b) by 0 days.

(21) Appl. No.: 12/357,841

(22) Filed: Jan. 22, 2009

(65) Prior Publication Data

US 2009/0178696 A1 Jul. 16, 2009

Related U.S. Application Data

(63) Continuation of application No. PCT/EP2007/006849, filed on Aug. 2, 2007.

(30) Foreign Application Priority Data

Aug. 24, 2006 (DE) ..... 10 2006 039 715

(51) Int. Cl.
*B08B 3/04* (2006.01)

(52) U.S. Cl. ..... 134/21; 134/34; 134/103.1; 134/186

(58) Field of Classification Search ..... 134/103.1, 134/186, 21, 34
See application file for complete search history.

(56) References Cited

U.S. PATENT DOCUMENTS 1,624,461 A * 4/1927 Barker ..... 134/103.1
1,983,931 A * 12/1934 Carter ..... 134/94.1
2,519,654 A * 8/1950 Heaney ..... 134/103.1
3,441,035 A * 4/1969 Edwards ..... 134/103.2
3,594,230 A 7/1971 Kierner
3,690,333 A * 9/1972 Kierner ..... 134/95.1
4,111,715 A * 9/1978 Sprengling et al. ..... 134/10
4,483,270 A * 11/1984 Toya et al. ..... 118/694
4,805,651 A * 2/1989 Takeuchi ..... 134/98.1
4,917,123 A * 4/1990 McConnell et al. ..... 134/95.2
5,049,510 A * 9/1991 Repasi et al. ..... 436/176
5,246,025 A * 9/1993 Cawlfield ..... 134/102.2
5,690,751 A 11/1997 Hösel et al.

(Continued)

FOREIGN PATENT DOCUMENTS

DE 1725648 5/1956

(Continued)

OTHER PUBLICATIONS

International Searching Authority, International Search Report for International Application No. PCT/EP2007/006849, Dec. 20, 2007, 6 pages.

(Continued)

*Primary Examiner*—Frankie L Stinson
(74) *Attorney, Agent, or Firm*—Hanley, Flight & Zimmerman, LLC

(57) ABSTRACT

In order to produce a cleaning device comprising a flood chamber for accommodating a workpiece requiring cleaning and a flooding device for flooding the flood chamber with a liquid cleaning agent which is of simple construction and the flood chamber of which can be rapidly filled and emptied again, it is proposed that the flood chamber be connectable to a cleaning agent reservoir and that the flooding device comprise a blower for reducing the pressure in the flood chamber so that cleaning agent is sucked into the flood chamber from the cleaning agent reservoir due to the reduced pressure in the flood chamber.

20 Claims, 7 Drawing Sheets

U.S. PATENT DOCUMENTS

| | | | | |
|---|---|---|---|---|
| 5,785,875 | A * | 7/1998 | Hawthorne et al. | 216/41 |
| 5,839,457 | A | 11/1998 | Rijken et al. | |
| 6,253,462 | B1 | 7/2001 | Schwarz | |
| 6,575,178 | B1 | 6/2003 | Kamikawa | |

FOREIGN PATENT DOCUMENTS

| | | | |
|---|---|---|---|
| DE | 1771256 | | 6/1971 |
| DE | 2437564 | | 2/1976 |
| DE | 3009313 | | 9/1980 |
| DE | 3715168 | | 12/1988 |
| DE | 19527317 | | 2/1996 |
| DE | 4446587 | | 6/1996 |
| DE | 19609783 | | 9/1997 |
| DE | 19714603 | | 10/1998 |
| DE | 4329178 | | 11/2006 |
| JP | 64-064617 | * | 3/1989 |

OTHER PUBLICATIONS

German Office Action for Application No. 10 2006 039 715.0, Aug. 28, 2007, 4 pages.

* cited by examiner

CLEANING DEVICE INCLUDING A FLOOD CHAMBER

RELATED APPLICATION

This application is a continuation application of PCT/EP2007/006849 filed Aug. 2, 2007, the entire specification of which is incorporated herein by reference.

FIELD OF DISCLOSURE

The present invention relates to a cleaning device including a flood chamber for accommodating a workpiece requiring cleaning and also including a flooding device for flooding the flood chamber with a liquid cleaning agent.

BACKGROUND

Such cleaning devices using floodable flood chambers are known from the state of the art. Therein, the flood chamber is either filled with the cleaning agent by means of a pump, or the cleaning agent enters the flood chamber from a reservoir container located above the flood chamber due to the effect of the force of gravity. The process of emptying the flood chamber into a receptacle located below the flood chamber is effected by the force of gravity or by means of a pumping process using a further pump.

These known flooding devices are technologically complex and lead to long filling times and emptying times when using large flood chambers.

SUMMARY OF THE INVENTION

The object of the present invention is to provide a cleaning device of the kind specified hereinabove which is of simple construction and the flood chamber of which can be rapidly filled and then emptied again.

In accordance with the invention, this object is achieved in the case of a cleaning device including the features indicated in the preamble of claim 1 in that the flood chamber is connectable to a cleaning agent reservoir and in that the flooding device comprises a blower for reducing the pressure in the flood chamber so that cleaning agent is sucked out of the cleaning agent reservoir into the flood chamber due to the reduced pressure in the flood chamber.

The cleaning device in accordance with the invention offers the advantage that neither an upwardly disposed reservoir container nor a filling pump or an emptying pump for the flood chamber are needed.

Due to the difference between the external pressure, which is effective on the cleaning agent reservoir, and the internal pressure in the flood chamber, the cleaning agent is forced into the flood chamber and rises therein up to a filling height which corresponds to the differential pressure.

The emptying of the flood chamber can take place in simple manner in that the blower is switched off or is separated from the flood chamber so that the pressure in the flood chamber rises again and the sucked-in cleaning agent drops down into the cleaning agent reservoir under the effect of the force of gravity.

Rapid filling and emptying of the flood chamber are ensured in this way.

In the cleaning device in accordance with the invention, the cleaning agent is again located in the cleaning agent reservoir after the end of a flood washing cycle, just as it was at the beginning of the flood washing cycle, whereas, in the case of the known cleaning devices in which the cleaning agent is filled into the flood chamber from a reservoir container located above the flood chamber and is emptied out into a receptacle located below the flood chamber after the flood washing process, the cleaning agent has to be pumped back into the reservoir container located thereabove before the beginning of a new flood washing process.

In a preferred embodiment of the invention, provision is made for the flood chamber to have an inlet opening at the bottom thereof through which the cleaning agent enters the flood chamber from the cleaning agent reservoir.

Preferably, the bottom inlet opening extends over almost the entire horizontal cross section of the flood chamber. In this way, a particularly large cross section for the flow of the cleaning agent is made available so that both filling the flood chamber and emptying the flood chamber can take place very rapidly.

The flood chamber is preferably at least partly inserted into the cleaning agent reservoir during the flooding process. In this way, the cleaning agent can rise directly into the flood chamber from the cleaning agent reservoir without a need for the cleaning agent to pass through a line system located therebetween, something which would entail frictional losses and a small through-flow cross section.

It is particularly expedient, if the flood chamber comprises an inlet opening at the bottom thereof for the entry of the cleaning agent from the cleaning agent reservoir and if the bottom inlet opening is inserted into the cleaning agent reservoir during the flooding process.

The cleaning agent reservoir is preferably coupled to the surrounding atmosphere so that the external pressure of the ambient air is effective on the cleaning agent reservoir.

In order to enable the workpiece requiring cleaning to be brought into the flood chamber, provision may be made for the flood chamber to be movable relative to the cleaning agent reservoir from a rest position located outside the cleaning agent reservoir into a working position in which the flood chamber is at least partly inserted into the cleaning agent reservoir.

As an alternative or in addition thereto, provision may be made for the flood chamber to be in multipart form and for it to be closable before the flooding process by the relative movement of at least two flood chamber parts towards one another.

In order for the cleaning agent to reach a high fill-height in the flood chamber and so as to enable the workpiece requiring cleaning to be completely inserted, it is of advantage if the internal pressure in the flood chamber is adapted to be lowered with respect to the external pressure by means of the blower by at least 200 mbar, preferably by at least 400 mbar.

Due to the sinking of the internal pressure in the flood chamber with respect to the external pressure, the cleaning agent is forced into the flood chamber by the pressure of the ambient air until the filling height of the cleaning agent within the flood chamber corresponds to the difference between the external pressure and the internal pressure.

In order to enable an adequate difference in pressure between the interior of the flood chamber and the environment to be produced, it is expedient if the blower has a throughput of at least approximately 300 $m^3/h$, preferably of at least 600 $m^3/h$.

In a preferred embodiment of the invention provision is made for the blower to be in the form of a side channel compressor. Side channel compressors are particularly suitable for producing high differential pressures and thus a low internal pressure in the flood chamber.

For intensifying the cleansing effect produced by flooding the flood chamber, a propeller washing device can be arranged in the flood chamber for producing a current flow which dislodges impurities from the workpiece requiring cleaning when the flood chamber is flooded.

As an alternative or in addition thereto, at least one spray nozzle assembly may be provided in the flood chamber.

This spray nozzle assembly can be used for directing a high pressure jet of cleaning agent at the workpiece requiring cleaning when the flood chamber is flooded.

Furthermore, such a spray nozzle assembly can serve for directing a jet of cleaning agent at the workpiece requiring cleaning before or after the flooding process.

In a preferred embodiment of the invention, provision is made for the cleaning device to comprise a conveyor device for conveying workpieces into the body of the flood chamber.

Such a conveyor device may comprise, in particular, a traversing stepping conveyor.

Furthermore, provision may be made for the conveyor device to comprise at least one bounding wall part which forms a boundary for the cleaning agent reservoir during the flooding process.

In order to enable the flood chamber to be flooded as completely as possible with the cleaning agent, it is of advantage if an air outlet is arranged at a highest point of the interior of the flood chamber for sucking out air by means of the blower.

Furthermore, the present invention relates to a method of cleaning a workpiece arranged in a flood chamber by flooding the flood chamber with a liquid cleaning agent.

The further object of the present invention is to provide a method of the previously mentioned type with the aid of which the flood chamber can be rapidly filled and emptied again.

In accordance with the invention, this object is achieved by a method of cleaning a workpiece arranged in a flood chamber by flooding the flood chamber with a liquid cleaning agent, which comprises the following process steps:

connecting the flood chamber to a cleaning agent reservoir;

reducing the pressure in the flood chamber by means of a blower in such a manner that cleaning agent is sucked into the flood chamber from the cleaning agent reservoir due to the reduced pressure in the flood chamber.

Further features and advantages of the invention form the subject matter of the following description and the graphical illustration of exemplary embodiments.

BRIEF DESCRIPTION OF THE DRAWINGS

Similar or functionally equivalent elements are designated by the same reference symbols in each of the Figures.

DETAILED DESCRIPTION OF THE DRAWINGS

Figure 1:
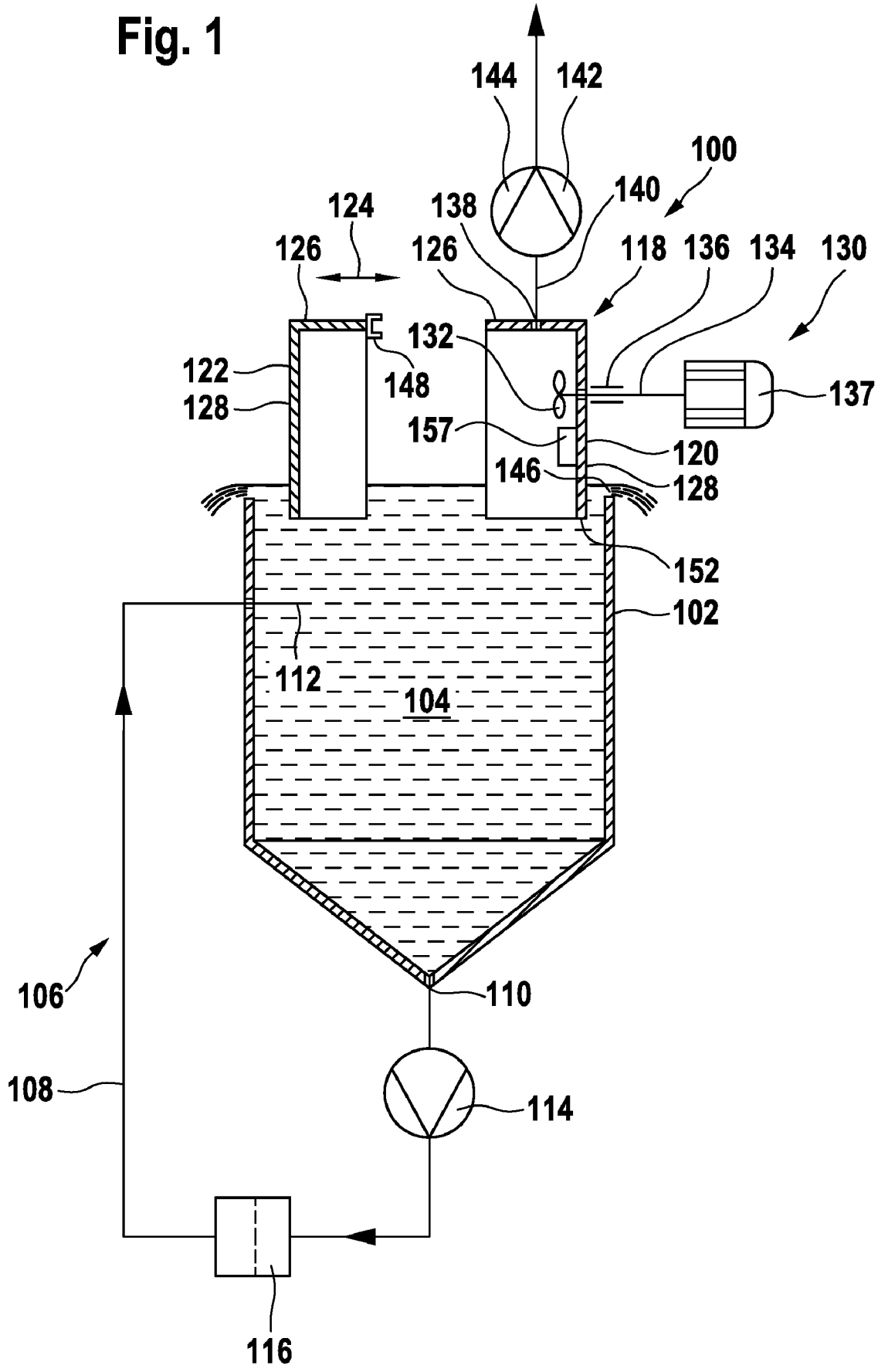
FIG. 1 shows a schematic illustration of a cleaning device comprising a divided flood chamber the open lower end of which dips into a cleaning agent reservoir when the flood chamber is opened.
Figure 2:
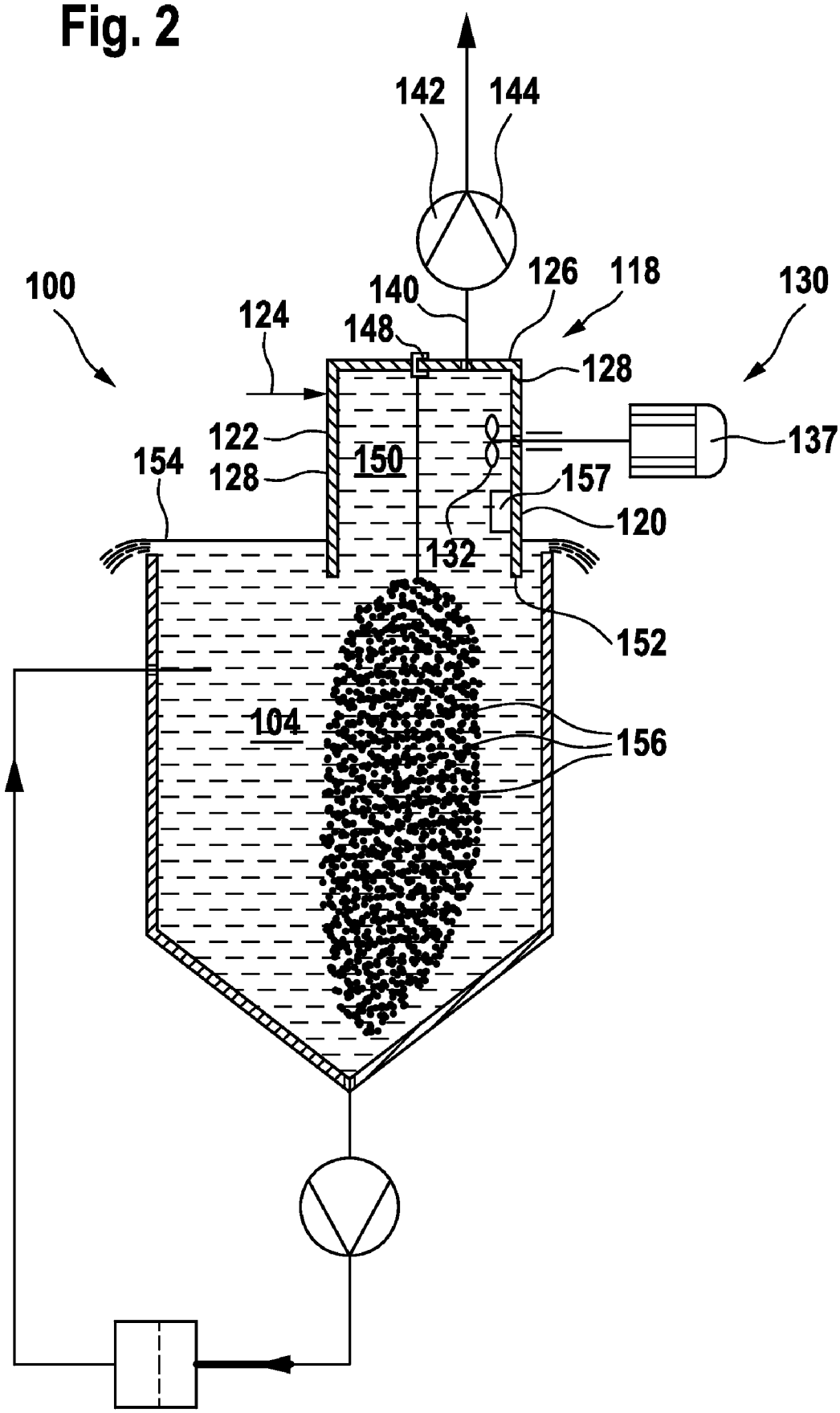
FIG. 2 a schematic illustration of the cleaning device depicted in FIG. 1 when the flood chamber is closed.

A cleaning device bearing the general reference 100 in FIGS. 1 and 2 comprises a cleaning agent container 102 which is open at its upper end and contains a cleaning agent reservoir 104.

The cleaning agent in the cleaning agent reservoir 104 can be filtered by means of a filtering circuit 106 comprising a filter line 108 which leads from a cleaning agent outlet 110 at the deepest point of the cleaning agent container 102 to a cleaning agent inlet 112 in the upper part of the cleaning agent container 102 and in which there are arranged a filter pump 114 and a cleaning agent filter 116 located downstream of the filter pump 114.

The cleaning agent can thus be sucked out of the cleaning agent reservoir 104 by means of the filter pump 114 and then fed back in a cleansed condition through the cleaning agent inlet 112 into the cleaning agent reservoir 104 after it has passed through the cleaning agent filter 116.

Furthermore, the cleaning device 100 comprises a divided flood chamber 118 having a first stationary part 120 and a second part 122 which is moveable relative to the first part 120 along a horizontal direction of displacement 124.

Each of the two parts 120 and 122 of the flood chamber 118 comprises a cover wall 126 and three horizontal side walls 128 and they are open at their lower end as well as at their mutually facing sides.

On the first part 120 of the flood chamber 118, there is arranged a turbo-washing device 130 which comprises a propeller 132 the drive shaft 134 of which is passed through one of the side walls 128 of the first part 120 of the flood chamber 118 in fluid-tight manner by means of a rotary shaft seal 136 and a drive unit 137 for producing a rotatory movement of the drive shaft 134.

An air suction line 140 having a blower 142 in the form of a side channel compressor 144 arranged therein is attached to an air outlet 138 in the cover wall 126 of the first part 120 of the flood chamber 118.

Air is adapted to be sucked out of the closed flood chamber 118 through the air suction line 140 and expelled into the environment by means of the side channel compressor 144.

Fresh cleaning agent is supplied continuously to the cleaning agent container 102 so that cleaning agent is continuously flowing out by way of an overflow 146 of the cleaning agent container 102.

This overflow of the cleaning agent serves to wash away oil that is floating on the surface of the cleaning agent reservoir 104.

The cleaning agent together with the washed-away oil that is overflowing from the cleaning agent container 102 is supplied to a (not illustrated) oil trap where the washed-away oil is separated from the cleaning agent. The remaining cleaning agent can be supplied back to the cleaning agent container 102.

The previously described cleaning device 100 functions as follows:

In the open position illustrated in FIG. 1 in which the multipart flood chamber 118 is opened and the two parts 120 and 122 of the flood chamber 118 are spaced apart in the horizontal direction, a (not illustrated) workpiece requiring cleaning is brought into the interior of the first part 120 of the flood chamber 118 and/or into the gap between the two parts 120 and 122 of the flood chamber 118.

Subsequently, the second part 122 of the flood chamber 118 is moved against the first part 120 of the flood chamber 118 in the direction of displacement 124 by means of a (not illustrated) electric motor driven or pneumatically or hydraulically operated moving apparatus until the closed state of the cleaning device 100 that is illustrated in FIG. 2 is reached, wherein the cover walls 126 and the mutually aligned side walls 128 of the two parts 120, 122 of the flood chamber 118 fit together via a seal 148 so as to form a closed flood chamber 118 which is only open in the downward direction but which in all other respects has a closed interior 150 that is formed by the side walls 128 and the cover walls 126 and wherein the workpiece requiring cleaning is arranged.

The side channel compressor 144 is now activated, whereby air is sucked out of the interior 150 of the flood chamber 118 and hence the internal pressure in the flood chamber 150 is lowered with respect to the external pressure of the cleaning device 100.

The internal pressure can be lowered by approximately 450 mbar for example with respect to the external pressure of e.g. approximately 950 mbar by means of the side channel compressor 144.

The lower edge 152 of the flood chamber 118 is located some centimetres above the bath surface 154 of the cleaning agent reservoir 104, so that air from the environment cannot enter the flood chamber 118 from below, but rather the level of the cleaning agent in the flood chamber 118 rises to a filling height which corresponds to the difference in pressure between the external pressure and the internal pressure.

This filling height can amount to approximately 5 m for example.

A flood chamber 118 having an interior volume of 300 l for example can be filled in e.g. 1.5 s by a side channel compressor 144 having a throughput of 800 $m^3$/h for example.

The rapid filling of the flood chamber 118 with the cleaning agent from the cleaning agent reservoir 104 is assisted by the large cross section of the stream of liquid at the bottom of the flood chamber 118 which is as large as the surface area of the flood chamber 118.

Due to the operation of the turbo-washing device 130 incorporating the propeller 132 that is driven by the drive unit 137, an intensive current can be produced within the flood chamber 118 that is flooded with the cleaning agent, this thereby dislodging impurities from the workpiece requiring cleaning.

As an alternative or in addition to the turbo-washing device 130, there can also be provided one or more spray nozzles which direct one or more high pressure jets of cleaning agent at the workpiece requiring cleaning that is located in the flood chamber 118.

The impurities that have been dislodged from the workpiece requiring cleaning, which are indicated in FIG. 2 by the dots 156, are rapidly removed through the large opening in the base of the flood chamber 118 and sink downwardly through the cleaning agent reservoir 104 to the bottom of the cleaning agent container 102.

The filling of the flood chamber 118 with the cleaning agent due to the difference in pressure between the interior 150 of the flood chamber 118 and the external pressure enables the flood chamber 118 to be filled with the cleaning agent in bubble-free manner, this being of especial advantage if the workpiece requiring cleaning that is located in the filled flood chamber 118 is to be cleaned by means of an ultrasonic cleaning arrangement 157.

A second embodiment of a cleaning device 100 which is illustrated in FIGS. 3 to 6 likewise comprises a cleaning agent container 102 incorporating a cleaning agent reservoir 104, but in this embodiment, the cleaning agent container 102 is divided by a vertical partition 158 into a smaller inflow region 160 and a larger outflow region 162.

In this embodiment, the filtering circuit 106 comprises a filter line 108 which leads from a cleaning agent outlet 110 at the deepest point of the outflow region1 162 to a cleaning agent inlet 112 which opens into the inflow region 160.

In this filter line 108, there are arranged a filter pump 114, a cleaning agent filter 116 which is located downstream of the filter pump 114 and a flow rate regulator 164 which is located downstream of the cleaning agent filter 116.

In the filtering circuit 106, the cleaning agent runs from the outflow region 162 of the cleaning agent reservoir 104 through the filter line 108 into the inflow region 160 of the cleaning agent container 102 and from there, over an overflow 165 back into the outflow region 162 of the cleaning agent container 102.

In this embodiment of a cleaning device 100, the flood chamber 118 is not divided along a vertical plane, but rather, along a horizontal plane and it comprises a stationary first part 120 having four vertical side walls 128, it is open in both the upward and downward directions and the lower end thereof dips into the cleaning agent reservoir 104, and it also comprises a second part 122 which is moveable relative to the first part 120 in a vertical direction of displacement 124 and likewise comprises four side walls 128 which support a roof 166 of the flood chamber 118.

At the highest point of the roof 166, there is provided an air outlet 138 to which an air suction line 140 is attached, a blower 142 in the form of a side channel compressor 144 being arranged in said line.

The air suction line 140 is adapted to be blocked by means of a non-return valve 168 arranged downstream of the side channel compressor 144.

An air return line 170 branches off from the air suction line 140 between the pressure-end outlet of the side channel compressor 144 and the non-return valve 168, said air return line opening into the interior 150 of the flood chamber 118 at an air inlet 172 arranged below the air outlet 138.

A non-return valve 174 and a ventilation flap 176 which is located downstream of the non-return valve 174 are arranged in the air return line 170.

A first spray nozzle assembly 178, which is attached via a first pressurised branch line 180 to a pressure line 182 which for its part is connected to the pressure side of a high-pressure pump 184, is provided in the interior of the first part 120 of the flood chamber 118.

A second spray nozzle assembly 186, which is likewise attached to the pressure line 182 via a flexible pressure line 188 and a second pressurised branch line 190, is provided in the interior of the second part of 122 of the flood chamber 118.

The suction side of the high-pressure pump 184 is connected by a suction line 192 to the inflow region 160 of the cleaning agent container 102.

Figure 3:
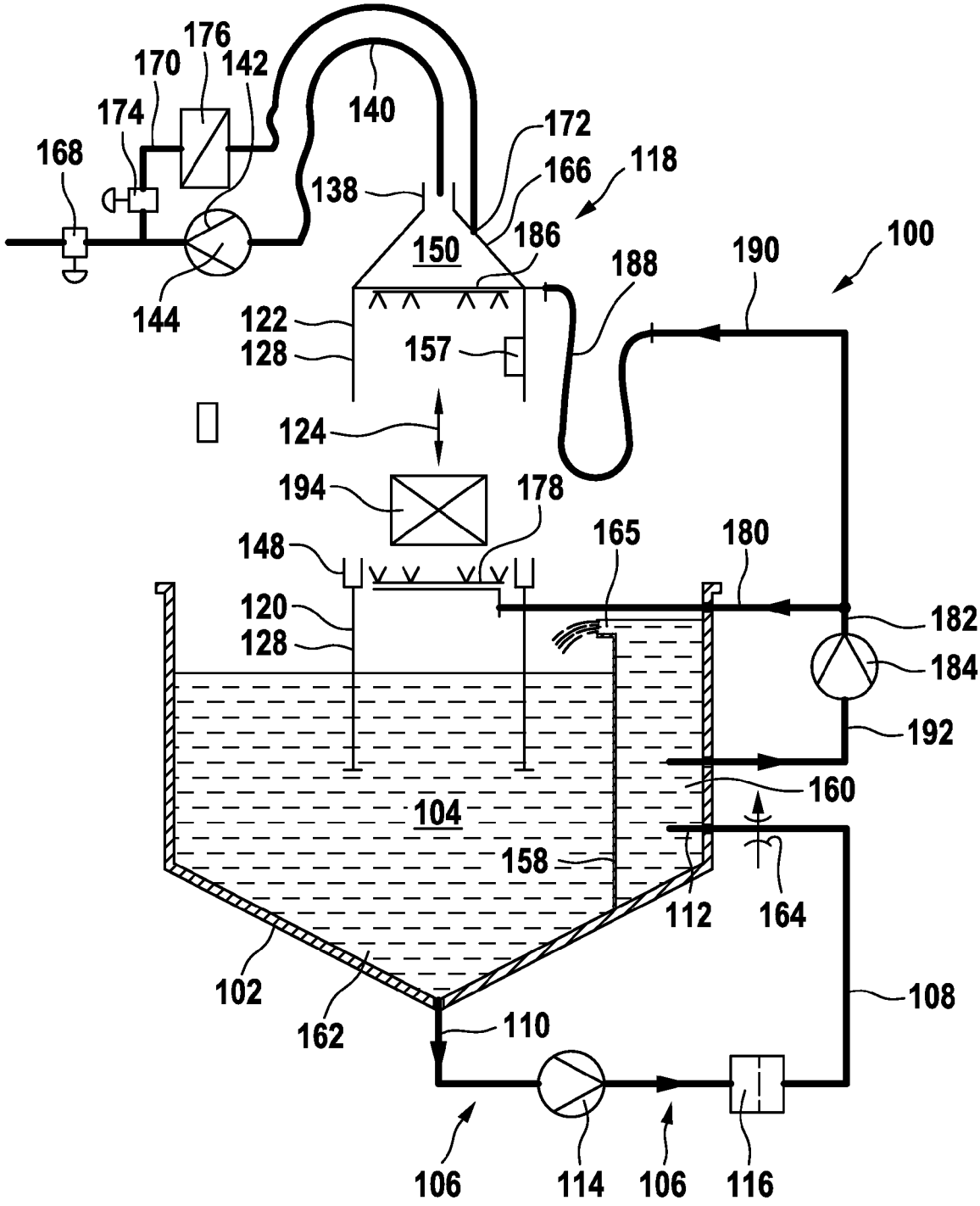
FIG. 3 a schematic illustration of a second embodiment of a cleaning device comprising a divided flood chamber the lower part of which dips into a cleaning agent reservoir when the flood chamber is opened.

The previously described second embodiment of a cleaning device 100 functions as follows:

In the open state of the cleaning device 100 in which the divided flood chamber 118 is opened as is illustrated in FIG. 3, a workpiece 194 requiring cleaning is brought into the gap between the first part 120 and the second part 122 of the flood chamber 118 by means of a (not illustrated) conveyor device.

Subsequently, the cleaning device 100 is moved downwardly by the movement of the second part 122 of the flood chamber 118 in the direction of displacement 124 into the closed position illustrated in FIG. 4 in which the lower edge of the second part 122 of the flood chamber 118 rests against the upper edge of the first part 120 of the flood chamber 118 in fluid-tight manner through the intermediary of a seal 148, so that the flood chamber 118 is closed and the workpiece 194 requiring cleaning is located in the interior 150 of the closed flood chamber 118.

Figure 4:
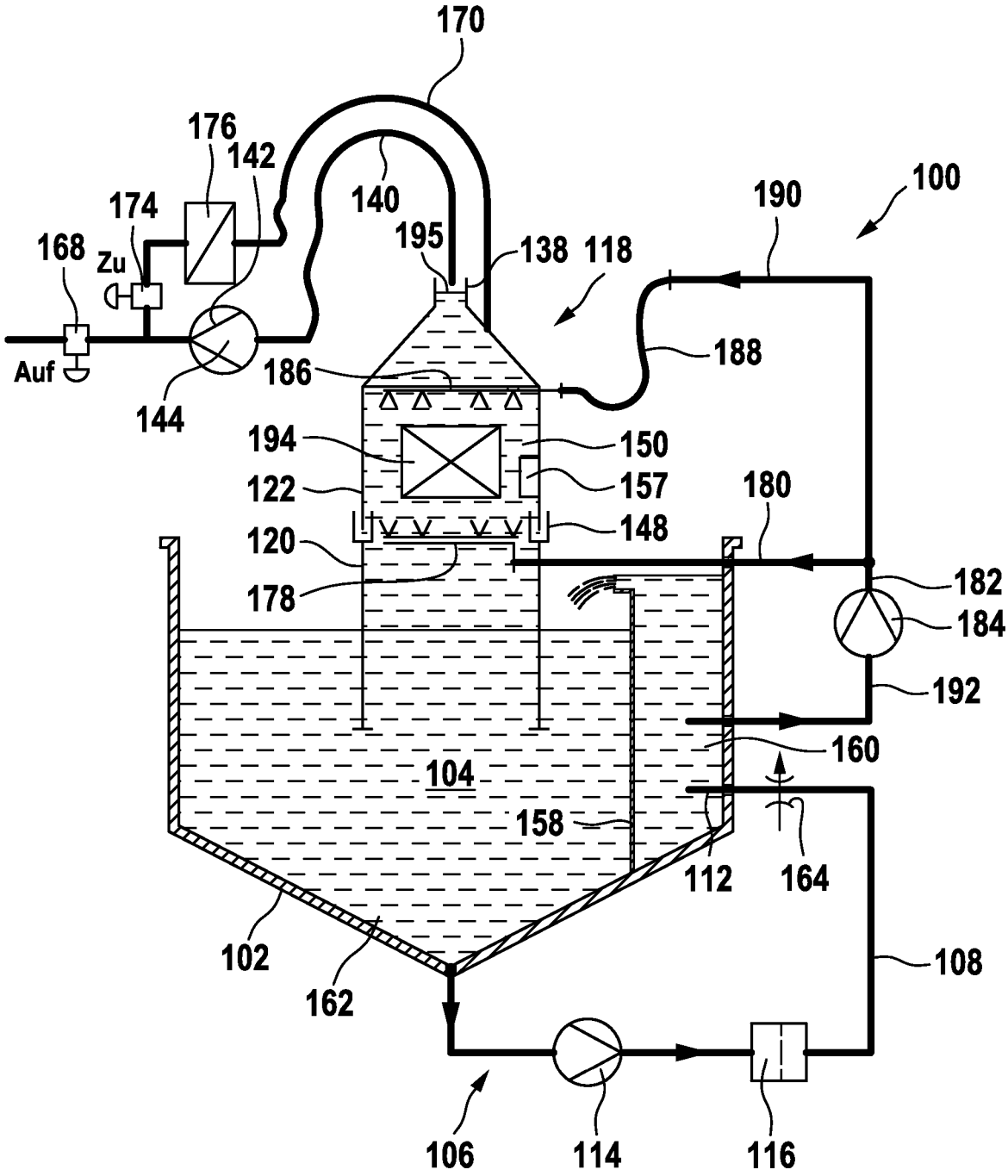
FIG. 4 a schematic illustration of the cleaning device depicted in FIG. 3 wherein the flood chamber is closed in a flood washing phase.

A flood washing process is then initiated in the interior 150 of the fluid chamber 118 in that the non-return valve 168 in the air suction line 140 is opened, the non-return valve 174 in the air return line 170 is closed and the side channel compressor 144 is activated, whereby the internal pressure in the flood chamber 118 is lowered with respect to the external pressure so that the level 195 of the cleaning agent in the flood chamber 118 rises above the work piece 194 requiring cleaning and the second spray nozzle assembly 186 (see FIG. 4).

For the purposes of intensifying the cleaning effect, the workpiece 194 requiring cleaning can be subjected to jets of cleaning agent by means of the spray nozzle assemblies 178 and 186. To this end, the high-pressure pump 184 is operated at a supply pressure of approximately 10 bar for example and has a throughput of approximately 50 $m^3/h$ for example.

The cleaning agent is circulated continuously through the filtering circuit 106, i.e. during the flood washing phase as well, whereby the filter pump 114 is operated at a supply pressure of approximately 2.5 bar for example and has a throughput of approximately 60 $m^3/h$ for example.

At the expiry of the predetermined flood washing time period, the flood washing process is terminated by closing the non-return valve 168 in the air suction line 140 and the interior 150 of the flood chamber 118 is ventilated by opening the ventilation flap 176 in the air return line 170, and as a result, the internal pressure in the flood chamber 118 is equalised to the external pressure so that the level of the cleaning agent in the flood chamber 118 drops back to the height of the level of the cleaning agent outside the flood chamber 118.

Figure 5:
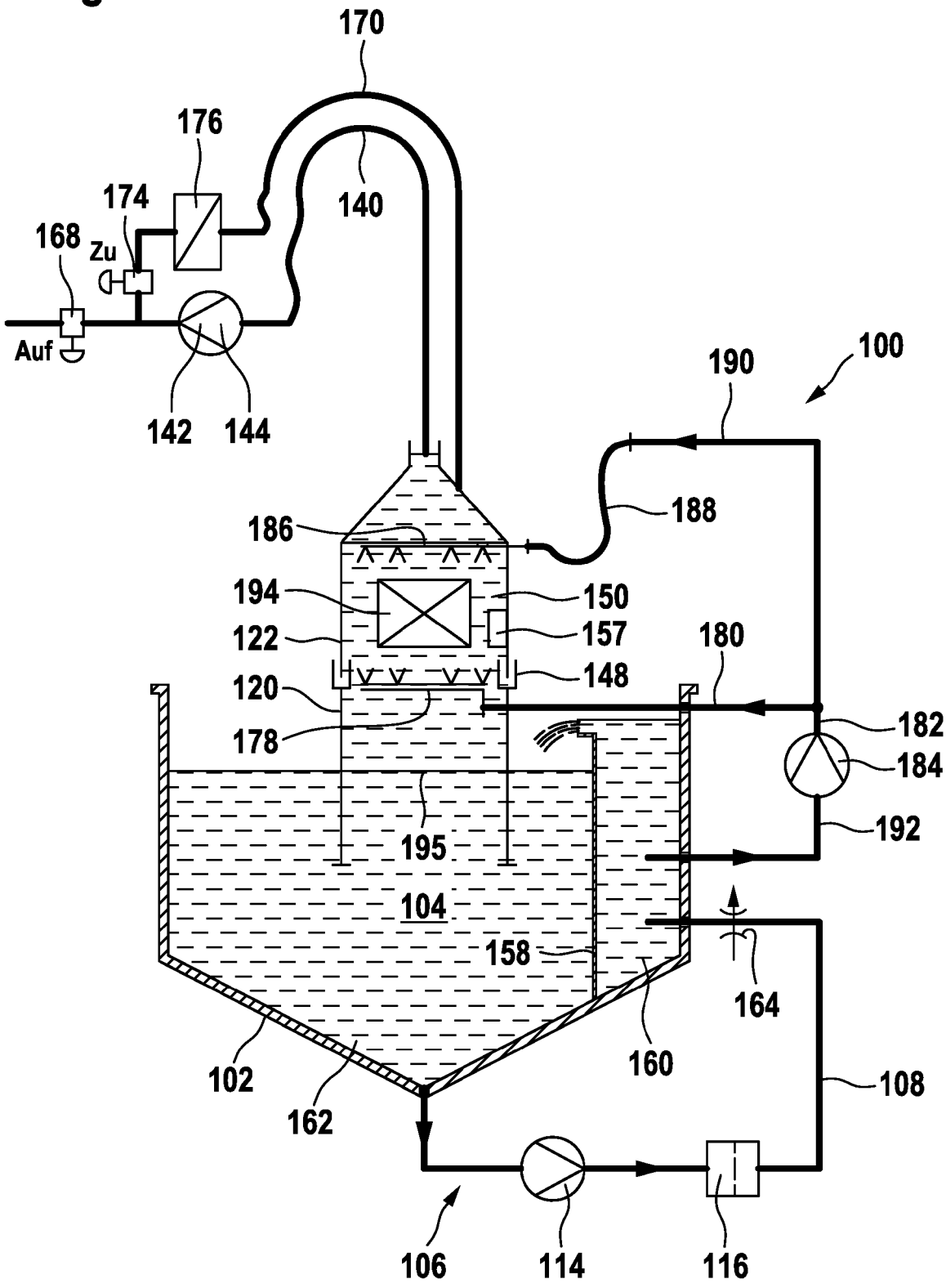
FIG. 5 a schematic illustration of the cleaning device depicted in FIGS. 3 and 4 wherein the flood chamber is closed in a spray cleaning phase.

The flood washing phase is followed by the spraying cleaning phase of the cleaning device 100 illustrated in FIG. 5, in which the non-return valve 168 in the air suction line 140 is opened, the non-return valve 174 in the air return line 170 is closed and the side channel compressor 144 is deactivated.

In this spraying cleaning phase, the high-pressure pump 184 is reactivated so that it advances the cleaning agent from the inflow region 160 of the cleaning agent container 102 to the spray nozzle assemblies 178, 186 which subject the workpiece 194 requiring cleaning to the jets of cleaning agent.

Since the side channel compressor 144 is deactivated, the internal pressure in the flood chamber 118 corresponds to the external pressure and the level of the cleaning agent 195 in the flood chamber 118 is at the same level as the level of the cleaning agent outside the flood chamber 118.

Figure 6:
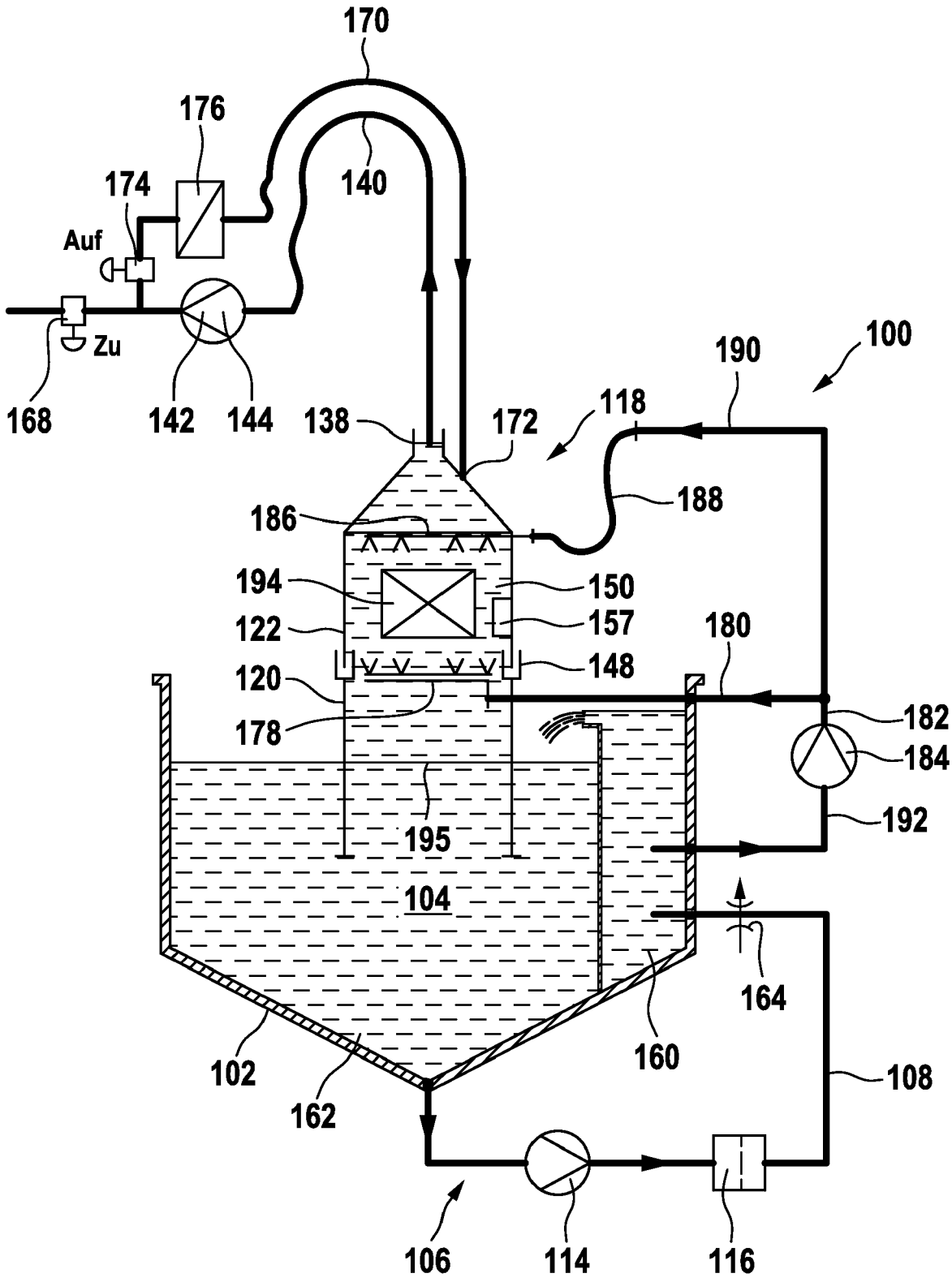
FIG. 6 a schematic illustration of the cleaning device depicted in FIGS. 3 to 5 wherein the flood chamber is closed in a blow-off phase.

A blow-off phase of the cleaning device 100 which is illustrated in FIG. 6 is then initiated by opening the non-return valve 174 in the air return line 170, closing the non-return valve 168 in the air suction line 140 and activating the side channel compressor 144.

In this blow-off phase, blow-off air is blown through the air inlet 172 into the interior 150 of the flood chamber 118 and then removed from the flood chamber 118 through the air outlet 138. This air is caused to circulate through the air suction line 140 and the air return line 170 by means of the side channel compressor 144.

In this way, the workpiece 194 requiring cleaning is freed of any remaining adherent residues of the cleaning agent and from impurities.

After the blow-off phase has concluded, the side channel compressor 144 is deactivated and the flood chamber 118 is opened by the upward movement of the second part 122 of the flood chamber, whereupon the workpiece 194 requiring cleaning is removed by means of the (not illustrated) conveyor device and a new workpiece 194 requiring cleaning is brought into the gap between the two parts 120 and 122 of the flood chamber 118, and thereupon, a new cycle of the cleaning device 100 begins.

Figure 7:
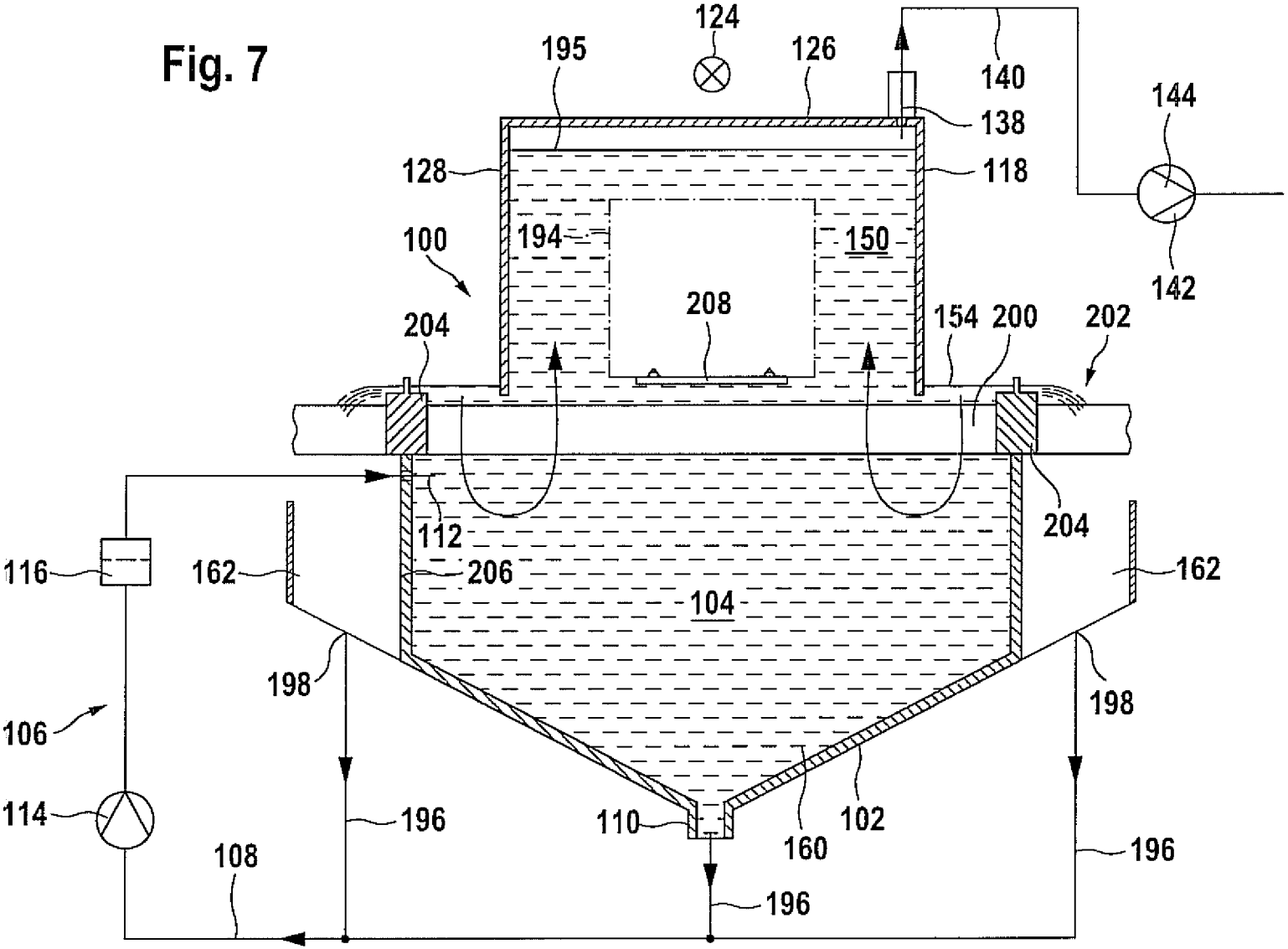
FIG. 7 a schematic illustration of a third embodiment of a cleaning device comprising a flood chamber the open lower end of which dips into a cleaning agent reservoir, and with a traversing stepping conveyor.

A third embodiment of a cleaning device 100 which is illustrated in FIG. 7 comprises a cleaning agent container 102 incorporating a central inflow region 160 and two lateral outflow regions 162.

A filtering circuit 106 comprises a filter line 108 which is connected by cleaning agent removal lines 196 to cleaning agent outlets 198 of the lateral outflow regions 162 and to a cleaning agent outlet 110 of the inflow region 160 of the cleaning agent container 102.

A filter pump 114 and a cleaning agent filter 116 are arranged in the filter line 108.

The filter line 108 opens into the inflow region 160 of the cleaning agent container 102 through a cleaning agent inlet 112.

The cleaning agent container 102 is crossed by a walking beam 200 of a traversing stepping conveyor 202.

The traversing stepping conveyor 202 serves to convey a workpiece 194 requiring cleaning into a cleaning position in the interior 150 of a flood chamber 118 and to convey it out of the flood chamber 118 again after the cleaning process.

Baffle plates 204 are arranged on the walking beam 200 and, in the quiescent position of the traversing stepping conveyor 202 illustrated in FIG. 7, said plates are seated on the upper edges of the side walls 206 of the inflow region 160 of the cleaning agent container 102 and thus form an extension of these side walls 206 in the upward direction.

The level 154 of the cleaning agent in the cleaning agent reservoir 104 arranged in the cleaning agent container 102 extends between the upper edges of the baffle plates 204.

Cleaning agent can flow out from the inflow region 160 of the cleaning agent container 102 into the lateral outflow regions 162 over the upper edges of the baffle plates 204.

In this embodiment, the flood chamber 118 is also divided, whereby the two parts of the flood chamber 118 are displaceable relative to each other in a direction of displacement 124 directed perpendicularly to the plane of the drawing in FIG. 7 in order to open and close the flood chamber 118.

An air outlet 138 via which an air suction line 140 is attached to a blower 142 in the form of a side channel compressor 144 is arranged in a cover wall 126 of the flood chamber 118.

The previously described third embodiment of a cleaning device 100 functions as follows:

When the flood chamber 118 is opened, a workpiece 194 requiring cleaning is brought into the gap between the two parts of the divided flood chamber 118 and placed on a workpiece mounting plate 208 in the course of a traversing step of the traversing stepping conveyor 202.

The flood chamber 118 is subsequently closed by means of a (not illustrated) moving apparatus.

Thereafter, the side channel compressor 144 is activated whereby the internal pressure in the interior 150 of the flood chamber 118 is lowered with respect to the external pressure of e.g. approximately 950 mbar to a value of 500 mbar for example.

The level 195 of the cleaning agent within the flood chamber 118, which is downwardly open so that the lower edges of its side walls 128 dip into the cleaning agent reservoir 104 in the cleaning agent container 102, thereupon rises over the workpiece 194 requiring cleaning, At the expiry of the envisaged flood washing time period, the side channel compressor 144 is deactivated, whereupon the internal pressure in the flood chamber 118 equalises once more with the external pressure so that the level 195 of the cleaning agent in the interior 150 of the flood chamber 118 drops again and adapts to the level 154 of the cleaning agent outside the flood chamber 118.

After the opening of the divided flood chamber 118, the cleaned workpiece 194 is lifted off the workpiece mounting plate 208 by a traversing step of the traversing stepping conveyor 202 and carried off in the longitudinal direction of the walking beam 200, whilst a further workpiece 194 requiring cleaning is advanced by the traversing stepping conveyor 202 onto the workpiece mounting plate 208, whereupon the cleaning cycle of the cleaning device 100 is repeated.

The invention claimed is:

1. A cleaning device including a flood chamber for accommodating a workpiece requiring cleaning, and also including a flooding device for flooding the flood chamber with a liquid cleaning agent, wherein the flood chamber is connectable to a cleaning agent reservoir, wherein the flooding device comprises a blower for reducing the pressure in the flood chamber so that cleaning agent is sucked into the flood chamber from the cleaning agent reservoir due to the reduced pressure in the flood chamber, wherein the flood chamber is at least partly inserted into the cleaning agent reservoir during the flooding process and wherein the flood chamber is in multipart form and is closable before the flooding process by the relative movement of at least two flood chamber parts.

2. A cleaning device in accordance with claim 1, wherein the flood chamber has an inlet opening at the bottom thereof for the entry of cleaning agent from the cleaning agent reservoir.

3. A cleaning device in accordance with claim 2, wherein the bottom inlet opening extends over almost the entire horizontal cross section of the flood chamber.

4. A cleaning device in accordance with claim 1, wherein the flood chamber comprises an inlet opening at the bottom thereof for the entry of the cleaning agent from the cleaning agent reservoir, and in that the bottom inlet opening is inserted into the cleaning agent reservoir during the flooding process.

5. A cleaning device in accordance with claim 1, wherein the flood chamber is movable relative to the cleaning agent reservoir from a rest position wherein it is located outside the cleaning agent reservoir into a working position in which the flood chamber is at least partly inserted into the cleaning agent reservoir.

6. A cleaning device in accordance with claim 1, wherein the internal pressure in the flood chamber is adapted to be lowered with respect to the external pressure by means of the blower by at least 200 mbar, preferably by at least 400 mbar.

7. A cleaning device in accordance with claim 1, wherein the blower has a throughput of at least approximately 300 m3/h, preferably of at least 600 m3/h.

8. A cleaning device in accordance with claim 1, wherein the blower is in the form of a side channel compressor.

9. A cleaning device in accordance with claim 1, wherein a propeller washing device is arranged in the flood chamber.

10. A cleaning device in accordance with claim 1, wherein at least one spray nozzle assembly is provided in the flood chamber.

11. A cleaning device in accordance with claim 1, wherein the cleaning device comprises a conveyor device for conveying workpieces into the region of the flood chamber.

12. A cleaning device in accordance with claim 11, wherein the conveyor device comprises a traversing stepping conveyor.

13. A cleaning device in accordance with claim 11, wherein the conveyor device comprises at least one bounding wall part which forms a boundary for the cleaning agent reservoir during the flooding process.

14. A cleaning device in accordance with claim 1, wherein an air outlet is arranged at a highest point of the interior of the flood chamber for sucking out air by means of the blower.

15. A cleaning device in accordance with claim 1, wherein the cleaning device comprises an air suction line which is connected to the flood chamber and adapted to be blocked by a valve and an air return line which is connected to the flood chamber and wherein a ventilation flap is arranged.

16. A cleaning device in accordance with claim 1, wherein the cleaning device comprises an ultrasonic cleaning arrangement for cleaning the workpiece.

17. A method of cleaning a workpiece in a flood chamber by flooding the flood chamber with a liquid cleaning agent which comprises the following process steps:

connecting the flood chamber to a cleaning agent reservoir;

reducing the pressure in the flood chamber by means of a blower in such a manner that cleaning agent is sucked into the flood chamber from the cleaning agent reservoir due to the reduced pressure in the flood chamber;

wherein the flood chamber is at least partly inserted into the cleaning agent reservoir during the flooding process and wherein the flood chamber is in multipart form and is closable before the flooding process by the relative movement of at least two flood chamber parts.

18. A method in accordance with claim 17, wherein the flooding process is terminated by closing a valve in an air suction line connected to the flood chamber and by ventilating an interior of the flood chamber by opening a ventilation flap in an air return line connected to the flood chamber.

19. A method in accordance with claim 18, wherein the flood chamber is filled with the cleaning agent in bubble-free manner.

20. A method in accordance with claim 17, wherein the workpiece is cleaned by means of an ultrasonic cleaning arrangement.

* * * * *